United States Patent [19]

Ebneth

[11] 4,278,435

[45] Jul. 14, 1981

[54] PROCESS FOR THE PARTIAL METALLIZATION OF TEXTILE STRUCTURES

[75] Inventor: Harold Ebneth, Leverkusen, Fed. Rep. of Germany

[73] Assignee: Bayer Aktiengesellschaft, Leverkusen, Fed. Rep. of Germany

[21] Appl. No.: 125,411

[22] Filed: Feb. 28, 1980

[30] Foreign Application Priority Data

Mar. 16, 1979 [DE] Fed. Rep. of Germany ..... 2910460

[51] Int. Cl.[3] ..... D06Q 1/04; B41M 5/26

[52] U.S. Cl. ..... 8/471; 8/443; 8/927; 427/304; 427/305; 428/263

[58] Field of Search ..... 8/471; 427/304, 305; 428/263

[56] References Cited

U.S. PATENT DOCUMENTS 3,011,920 12/1961 Shipley ..... 427/304
4,201,825 5/1980 Ebneth ..... 428/263

FOREIGN PATENT DOCUMENTS 2005310 4/1979 United Kingdom .

OTHER PUBLICATIONS

Holland, G. and Litherland, A., J. Soc. Dyers and Colourists, 1971, 87, pp. 488–495.

*Primary Examiner*—A. Lionel Clingman
*Attorney, Agent, or Firm*—Sprung, Felfe, Horn, Lynch & Kramer

[57] ABSTRACT

This invention relates to a process for the production of a partially metallized textile structure of synthetic polymers or natural fibers, which comprises rendering the particular side or areas of the fabric which are not to be metallized hydrophobic or inactive by printing them with thermodiffusion dyes before the metal treatment.

1 Claim, No Drawings

PROCESS FOR THE PARTIAL METALLIZATION OF TEXTILE STRUCTURES

The present invention relates to a process for the production of partially metallized textile structures.

It is known that in processes for the production of partially metallized (partially coated with a layer of metal, e.g. by current-less metal deposition) textile sheet structures such as woven or knitted fabrics or nonwoven webs this partial metallization can be achieved by rendering hydrophobic or desactivating prior to the metal-deposition step those parts of the area of the fabric to be metallized which shall not be coated with metal (e.g. chapter 14.3.6 of G. G. Gawrilov "Chemische (stromlose) Vernicklung", Schriftenreihe Galvanotechnik No. 15 (1974), Eugen Leuze Verlag, Saulgau/Wuürtt.).

It has now surprisingly been found that testile sheet products and yarns can be partially metallized if one side is subjected to a preliminary treatment which prevents activation with noble metal nuclei which treatment is a printing with thermodiffusion dyes.

The present invention therefore relates to a process for the production of partially metallized textile structures from synthetic polymers or natural fibres, which comprises rendering hydrophobic or inactivating the particular side or areas of the fabric which are not to be metallized by printing it (them) with a thermodiffusion dye before the metallisation step.

This preliminary treatment resides in a modern transfer printing process using transfer printing paper and being known per se. Quite surprisingly, such transfer printing prevents activation of the printed side. Metallisation therefore only takes place on the parts which have not been printed. This process could in principle be used to print any textile sheets or yarns on one side only in order to achieve partial metallisation. The textiles used may for example be produced either from fibre forming synthetic polymers of polyamide, polyesters, polyalkylene, polyacrylene, polymodacryl or polyvinyl halides or mixtures of these substances or else from natural fibres such as cotton or wool or mixtures of natural fibres and synthetic fibres, e.g. bicomponent fibres.

The process of metallisation which per se is described in German Offenlegungsschrift No. 2 743 768 corresponding to U.S. Pat. No. 4,201,825 filed Sept. 27, 1978 is carried out as follows:

According to German Auslegeschrift No. 11 97 720, an activating solution of colloidal palladium is prepared using tin-II salts. The pH of the solution should always be $\leq 1$ and there should be an excess of tin-II ions present.

The materials which are to be activated, which are printed on one side are treated in this activating bath, preferably at room temperature, for periods ranging from a few seconds to a few minutes, for example 10 seconds to 2 minutes, without any other preliminary treatment. The treatment could be carried out for several minutes without producing any observable deleterious effects.

The activated material is then removed from the activating bath and rinsed with water, preferably at room temperature. In this connection it has proved to be partially advantageous to continue rinsing until the wash water is neutral. The rinsing process may be carried out in several stages.

The treated material is then subjected to an acid or alkaline medium for a period of from about 30 seconds to about 2 minutes. If an acid medium is used, a 5% by weight sulphuric acid or approximately 20% by weight hydrochlorid acid has been found to be sufficiently strong for this purpose. The material is however, preferably treated in an alkaline medium. The best results being obtained with an approximately 5% by weight caustic soda solution or an approximately 10% by weight soda solution, preferably used at room temperature.

The material is then briefly rinsed in water, preferably at room temperature, for example for up to 30 seconds, in order to remove excess treatment agent.

After this rinsing stage, the material is introduced, at a temperature from at about 18° C. to about 30° C. into an alkaline bath of a metal salt, in which currentless deposition of the metal to be deposited on the material takes place.

These metal salt baths are preferably baths of nickel salts, cobalt salts or mixtures thereof, copper salts, gold salts or other salts which can be deposited in currentless fashion from alkaline baths.

It is particularly preferred in the process of the present invention to use ammoniacal nickel baths or copper baths which have been rendered alkaline with a sodium hydroxide solution. The alkaline reaction of the medium may, of course, also be maintained with mixtures of ammonia and caustic soda.

Metallisation baths of this kind are known in the art of currentless metal deposition.

Baths of the following composition have proved to be particularly suitable:

A nickel bath of 0.2 mol per liter of nickel-II chloride, 0.9 mol per liter of ammonium hydroxide (25% by weight solution), 0.2 mol per liter of sodium hypophosphite and as much free ammonia as is necessary to adjust the pH to 8.9 at 30° C.; or a copper bath of 30 g per liter of copper-II sulphate, 100 g per liter of Rochelle salt and 50 ml per liter of a 37% by weight formaldehyde solution. This copper bath is adjusted to pH of 11 to 12 with sodium hydroxide.

$NaBH_4$ or a dialkyl amino borane may be used as the reducing agent instead of the hypophosphite or formaldehyde.

The dwell time of the material to be metallised in the metallisation bath described above depends upon the desired thickness of the metal layer on the surface of the material, but it is preferably in the range of 1 to 25 minutes. Layers of deposited metal ca 2/μm in thickness could be measured after a dwell time of ca. 5 minutes.

The process according to the present invention it is possible to produce a partially metallised textile having a surface resistance measured on the metallised surface according to DIN 54345 of $1 \times 10^3$ Ohm at 50% relative humidity and 23° C. max. while the non-metallised textile has a surface resistance of ca. $10^{13}$ Ohm.

A textile which has been partially metallised according to the process of the present invention is an excellent material, for example, for safety clothing in the textile sector, e.g. as protection against microwaves in the catering industry.

It is also excellent for the manufacture of antistatic cloths which have been colour printed before the metallisation process.

EXAMPLE 1

A fabric produced from an acrylonitrile polymer yarn (94% by weight acrylonitrile, 5.5% by weight methyl acrylate, 0.5% by weight sodium methallyl sulphonate) and printed on one side by the transfer printing process is immersed at room temperature in a hydrochloric acid bath pH 1) of a colloidal palladium solution according to German Auslegeschrift No. 11 97 720. After a dwell time of from 30 seconds to 2 minutes during which time it is kept lightly agitated, the fabric is removed from the bath and thoroughly rinsed with water. It is then introduced into a ca. 5% by weight caustic soda solution at room temperature. The material is treated in this solution for a period of from ca. 30 seconds to 2 minutes with gentle agitation and is then removed and rinsed with water. It is then introduced into a solution, e.g. of 0.2 mol per liter of nickel-II chloride 0.9 mol per liter of ammonium hydroxide and 0.2 mol per liter of sodium hypophosphite, into which ammonia is introduced to adjust the pH to 8.9 at 22° C. The surface of the textile sheet begins to discolour after ca. 15 seconds. After only 30 seconds, the unprinted side of the fabric is covered with a fine layer of metallic nickel and has become darkly coloured. After ca. 5 minutes, the nickel layer has a thickness of 0.2/μm. The material is then removed from the bath and thoroughly rinsed with water at room temperature until the reaction is neutral. The printed side of the fabric has not taken up any nickel and the original print has preserved its colour and quality.

The surface-resistance of the metallised side, measured according to DIN 543345 in Ohms at 50% relatively humidity and 23° C., was $5\times10^{1}$. The insulation resistance, measured according to DIN 54345 at 23° C. and 50% relative humidity, was $4\times10^{2}\Omega\times cm^{2}$.

The surface resistance of the printed, i.e. non-metallised side was $3\times10^{13}$ Ohm.

EXAMPLE 2

A fabric of polyacrylonitrile spun fibre yarn having a weight per unit area of 156 g/m² was printed on one side by the transfer printing process and chemically coated with nickel as described in Example 1. The material was kept in the nickel coating bath for 20 minutes. A ca. 0.7/μm thick layer of nickel was deposited on the unprinted side and completely covered it. The printed side was not metallised and retained its coloured decorative surface.

When the microwave absorption in transmission was measured on this spun fibre fabric partially covered with a 0.7/μm thick layer of nickel the following results were obtained:

| Thickness of Nickel layer in /μm | Frequency range in GHz | | |
|---|---|---|---|
| | 2–2.4 | 7–8 | 11–12 |
| 0.7 as single layer | 27 dB | 27 dB | 28 dB |
| ditto as double layer without insulating intermediate layer | 35 dB | 44 dB | 49 dB |

It was found that the adsorption values for microwaves in transmission were the same in both directions of passage. It follows that for the sake of appearance of the textile, the side which has been transfer printed and preserved its colour and decorative character may be placed on the outside.

The material is therefore suitable for the manufacture of protective clothing to protect persons against non-ionising radiation.

I claim:

1. A process for the production of a partially metallized textile structure of synthetic polymers, which comprises rendering the particular side of the fabric which is not to be metallized hydrophobic or inactive by printing it with thermodiffusion dyes before the metal treatment by currentless metal deposition.

* * * * *